US005402537A

United States Patent [19]

Kolada

[11] Patent Number: 5,402,537

[45] Date of Patent: Apr. 4, 1995

[54] INJECTION MOLDED BASEBALL GLOVE

[75] Inventor: Paul P. Kolada, Bexley, Ohio

[73] Assignee: Priority Designs, Inc., Columbus, Ohio

[21] Appl. No.: 916,477

[22] Filed: Jul. 20, 1992

[51] Int. Cl.[6] ..... A41D 13/08

[52] U.S. Cl. ..... 2/19; 2/161.1

[58] Field of Search ..... 2/16, 19, 158, 159, 2/160, 161.1, 161.3, 161.8, 167, 168, 910, 917; 223/78, 79, 80; 273/26 C, 26 R

[56] References Cited

U.S. PATENT DOCUMENTS

| | | | |
|---|---|---|---|
| 3,882,548 | 5/1975 | Shinagawa et al. | 2/161.1 |
| 4,279,681 | 7/1981 | Klimezky | 2/19 |
| 4,637,610 | 1/1987 | Carr | 2/19 |
| 4,665,561 | 5/1987 | Aoki | 2/19 |
| 4,896,376 | 1/1990 | Miner | 2/19 |

OTHER PUBLICATIONS

Sara Glove Catalog 1110, p. 2.

*Primary Examiner*—Clifford D. Crowder
*Assistant Examiner*—Diana L. Biefeld
*Attorney, Agent, or Firm*—Frank H. Foster

[57] ABSTRACT

A baseball or softball glove comprising a shell having a concave, frontal, ball-receiving surface and a rear surface to which a handpiece is attached. The handpiece may be removably or permanently attached and may comprise finger receiving loops formed on the rear surface of the shell. The handpiece is preferably a tight fitting, leather or fabric glove. The preferred shell comprises a sheet-like, flexible skin of a selected flexibility attached to a structural skeleton having a lower flexibility than the skin.

A plurality of raised bumps are formed on the ball-receiving surface of the shell near a palm region and around the outer perimeter. Elongated slots are formed through the shell, extending generally parallel to and between finger regions, and in a web region. Preferred lines of flexure are formed at at least one end of each slot, and are localized, thinned regions, along which the shell preferably flexes.

35 Claims, 9 Drawing Sheets

INJECTION MOLDED BASEBALL GLOVE

TECHNICAL FIELD

This invention relates to baseball gloves and more particularly relates to a baseball glove formed by molding plastic.

BACKGROUND ART

Baseball and softball gloves are conventionally made from leather and, as a result, are expensive and somewhat limited in the range of the variability of their functional and aesthetic design, manufacture and use. A typical ball glove has five thick, leather finger tubes extending outwardly from a flat, padded palm region. Four leather finger tubes are laced together, and a web connects a thumb finger tube to the other four finger tubes.

Leather ball gloves need what is known as a "break-in period" before they are optimally suited for use. The break-in period is the time during which the stiffness of the new leather glove is reduced by repeatedly flexing and chemically treating the glove to soften the leather, define lines of flexure and improve the fit and performance for the owner of the glove. The requirement of a leather glove to be broken in not only delays the use of a new leather glove, but also demonstrates that if the ball glove changes from the time it is new until the time it is broken in, then the ball glove is constantly changing during use, even after it is broken in. This constant variation of the glove is undesirable, since most athletes want their equipment to remain consistent in its performance so the athletes can depend upon its consistency, and concentrate on varying and improving their performance in order to attain optimum overall results.

The thickness of the leather required to make the glove structurally suitable inhibits any passages of air to the hand of the user. Any small air passages formed in the thick leather will allow little air to be passed to the user's hand by virtue of the long tunnel the air must traverse to contact the hand.

The typical leather glove is made by connecting a large number of leather pieces into an arranged shape. The pieces of leather must each be cut out or formed into a shape, sewn and laced together, and treated to preserve the leather. A large number of manufacturing steps are required to make a conventional leather ball glove, making the expense high. Variations in the qualities of leather introduce a large possibility for flaws in the finished glove.

The damage that occurs when leather becomes wet from water and later dries out is well known and is another problem with conventional leather ball gloves, especially those with inferior leather. The weight and physical structure necessary for forming a leather ball glove that will not only hold itself rigid under its own weight, but will also maintain its general overall shape upon impact of a ball being caught, also add to the disadvantages of leather ball gloves.

Another problem with conventional leather ball gloves is the difficulty of conforming the ball glove to any shape other than its open or closed shape. For example, when fielding a ball rolling on the ground, a player opens the leather glove and presses the finger tip end of the glove against the ground to give the ball a "ramp" from the ground up into the glove. Most conventional ball gloves provide only a small portion of the finger tip end of the glove along which the glove forms a ramp upon being pressed to the ground. Additionally, the thickness of the finger tubes provides an abrupt bump for the ball when rolling into contact with and onto the "ramp" the glove forms.

Attempts have been made to alleviate some of the problems of conventional leather ball gloves. Miner, in U.S. Pat. No. 4,896,376, uses shaped sheets of plastic which are sewn and riveted together to form a ball glove. The ball glove is weather proof, but the large number of manufacturing steps involved would require Miner's ball glove to be as expensive and as complex as a conventional leather ball glove.

Klimezky, in U.S. Pat. No. 4,279,681, describes a method called slush molding that is used to make a leather look-alike ball glove. This method includes pouring a liquid or powdered plastic into a heated mold and solidifying an outer shell. The liquid or powder that is not solidified is dumped and the shell is removed from the mold. As a second step, the finger holes are defined by forming spaced, linear welds that separate hollow cavities into which fingers are inserted by the user.

Injection molding involves pouring or forcing liquid into a cavity and then allowing the liquid to assume the shape of the cavity and solidify. Injection molding is well known, and has been used to form the soft plastic parts of gas masks and swim fins. Swim fins often have multiple plastics of different physical properties, such as hardness, molded together in a series of steps or molded separately and later assembled. However, baseball gloves have never been designed to utilize and accommodate plastic material characteristics and injection molding techniques. Instead, baseball gloves are all modelled after the conventional leather ball glove and their manufacturing methods.

The method of manufacturing Klimezky's ball glove is simpler than that used to manufacture conventional leather ball gloves and is also simpler than that used to manufacture Miner's ball glove. Additionally, Klimezky's ball glove would be weather proof if constructed of correctly selected materials. However, Klimezky emphasizes that it is of primary importance that his ball glove have very similar appearance to a leather ball glove. Klimezky also mentions that his glove is as good as a leather glove. The utility of a leather glove is in need of improvement, as discussed above and below.

One of the more prominent disadvantages of conventional leather ball gloves, and Klimezky and Miner's ball gloves, is that once the gloves are manufactured, there is little opportunity provided for variations in the size and shape of the hand of the person using the glove. Typically, a glove which is large can only be used by someone having a large hand, particularly long fingers. Klimezky's glove has a cavity in it into which a person's hand is inserted. If a small person wants to purchase a large glove made by Klimezky's method, the small person must insert his hand into the cavity and operate the glove regardless of the shape and size of his hand, with no provision for adjustment. Leather gloves have finger straps which can be loosened or tightened slightly, but the conventional leather glove still has finger tubes that are not variable in depth or diameter. Also, if an owner of a glove "breaks in" a leather glove, it is usually uncomfortable for a second person to use the glove, due to the leather having conformed to the owner's hand and the owner's flexure regions.

Therefore, there is a need for an improved ball glove that can be simply and inexpensively manufactured, is weather proof and consistent in its performance, and can be varied extensively after manufacture to fit various hand shapes and sizes. The ball glove should allow for design variability to allow it to be tailored before and after manufacture to the variations in hands and in fielding needs at different baseball or softball positions.

BRIEF DISCLOSURE OF INVENTION

The invention is a baseball or softball glove comprising a flexible, plastic shell. The plastic shell is molded into a curved, concave, frontal contour forming a ball-receiving surface and a rear surface. The ball glove further comprises a hand receiving handpiece, attached to the rear of the shell along finger regions.

BRIEF DESCRIPTION OF DRAWINGS

FIG. 2A shows the skin portion and FIG. 2B shows the skeleton portion of the shell.

Figures 1, 1A:
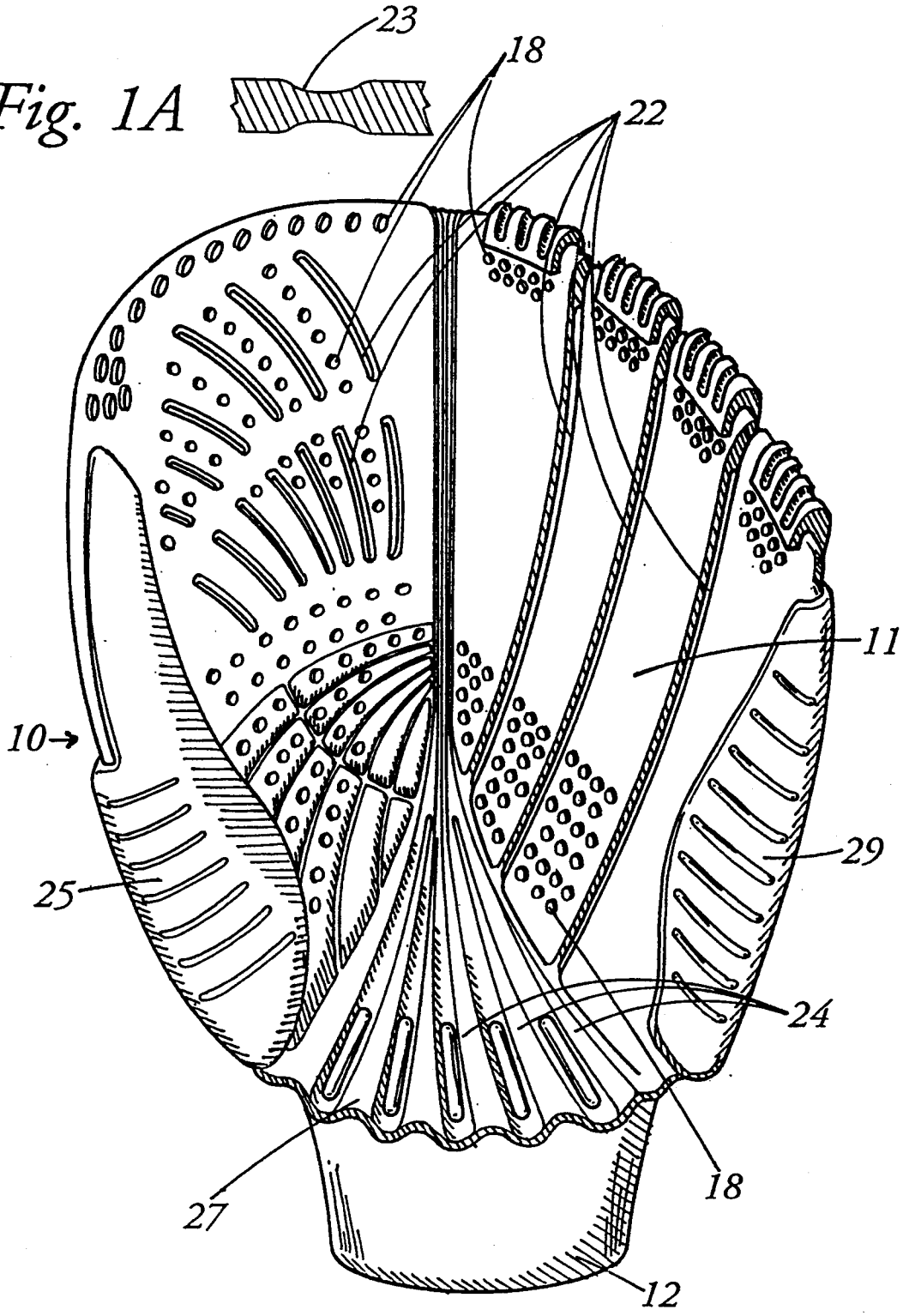
FIG. 1 is a frontal view in perspective illustrating the preferred embodiment of the present invention.
FIG. 1A illustrates a detail of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the present invention illustrated in FIG. 1 consists of a shell 10 attached to a handpiece 12. The shell 10 has a concave, ball-receiving, frontal surface 11, and a convex rear surface (not visible in FIG. 1) to which the handpiece 12 attaches.

Figure 2A:
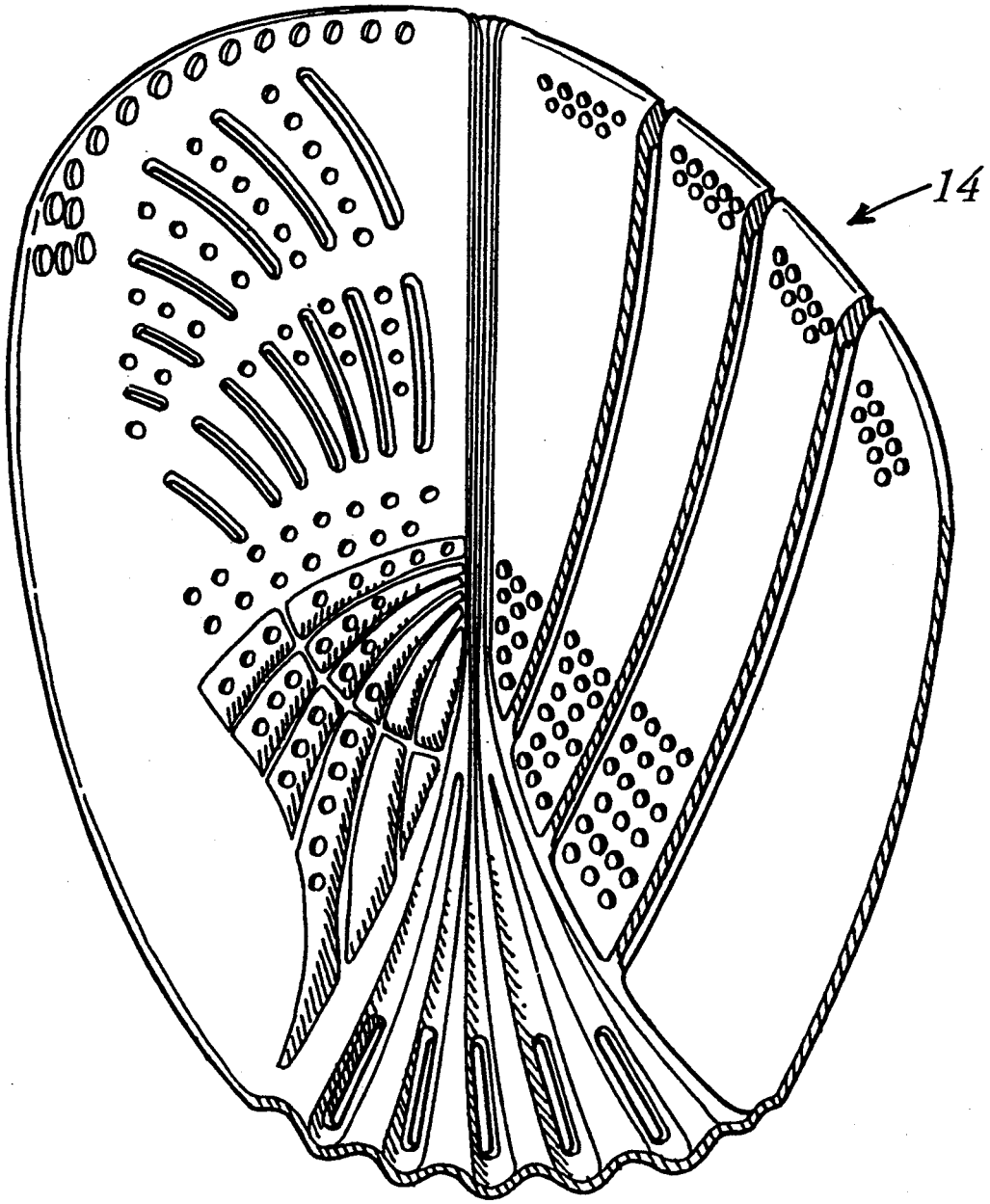
FIGS. 2A and 2B make up an exploded frontal view in perspective illustrating a two part assembly of the present invention.
Figure 2B:
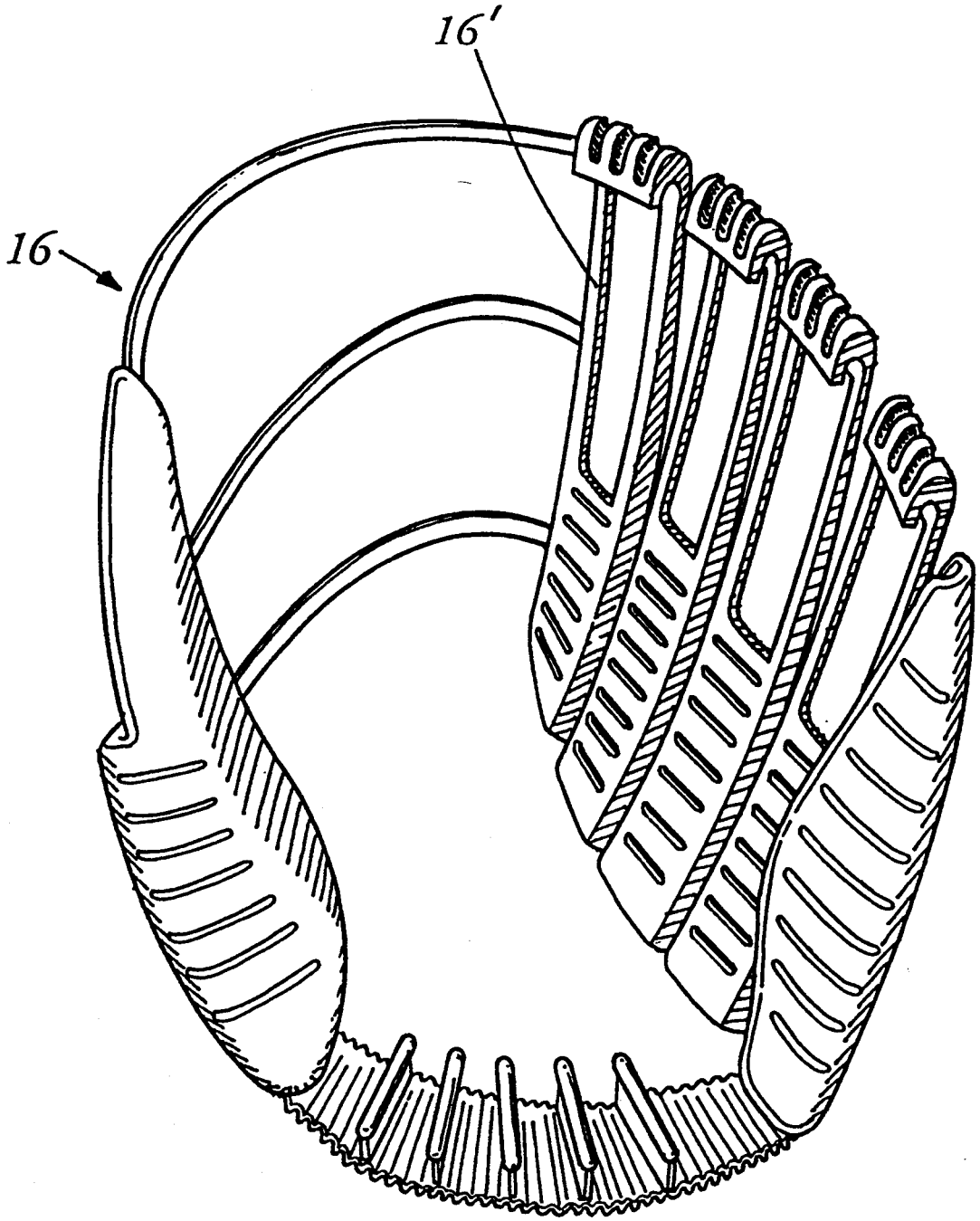

As shown in the exploded view of FIGS. 2A–2B, the shell 10 is preferably a two part assembly, one part of which is a flexible, sheet-like, preferably elastomeric skin 14. A skeleton 16, which is the second part of the shell 10, is comprised of frame members 16' which make up a structural framework that is stiffer than the skin 14. The skin 14 is attached to, and extends between and within, the framework of the skeleton 16, maintains the shape of the skeleton 16, and fills in gaps between skeletal members.

The skin 14 and skeleton 16 may be molded separately and then attached after they have solidified. It is equally possible to mold the skeleton 16, letting it solidify, then mold it to the skin 14.

The preferred materials used to form the shell 10 are thermoplastic elastomers and thermoplastic urethanes. Preferably, a shell 10 can be manufactured using, for example, a polyether amide sold under the trade name Pebax or a urethane sold under the trade name Pellethane. Ball gloves can also be made of PVC and of styrene blends, but will have poorer performance characteristics. The materials used perform well due to their tear resistance, tensile strength, flexural modulus and flexibility. The present invention is not limited to use of these materials, but these materials are used due to their properties. Other materials may be substituted for these materials if they have similar or superior strength, tear resistance, flexural modulus and flexibility properties.

Experiment has determined that these preferred materials advantageously exhibit these characteristics when formulated to have a flexural modulus and a durometer hardness within measured ranges. The preferred range of durometer hardness values for the skin 14 is between 50 and 70 on the shore A scale. The durometer hardness of the skeleton 16 preferably ranges between 65 and 90 on the shore A scale. The durometer hardness tests performed conformed to ASTM test methods for test D-2240. The preferred range of flexural modulus for the skin 14 is between 1500 psi and 3000 psi. For the skeleton 16 the flexural modulus range is between 2200 psi and 4000 psi. The flexural modulus tests performed conformed to ASTM test methods D-790.

The concave, ball-receiving surface of the shell 10 preferably has a plurality of raised bumps 18 formed around its perimeter and on a palm region of both the skin 14 and the skeleton 16. The primary purpose of the bumps 18 is to increase the grip on a ball by providing a mechanical interengagement between the bumps 18 on the shell 10, and seams and other surface contours on a ball. The bumps 18 improve the grip provided by friction alone and reduce the possibility that a ball in the shell 10 will slip out. The bumps 18 also concentrate a contacting ball's impact energy on the small areas and change the sound the ball makes when impacting the plastic shell 10, to give a typical ball glove sound and feel. The bumps 18 may be strategically shaped to promote or negligibly hinder movement of the ball deeper into the shell 10, while preventing the ball from being displaced out of the shell 10. For example, the bumps 18 may be ramp shaped or angled to give a "barb" effect allowing motion in one direction, but resisting it in the opposite direction. Additionally, the bumps 18 aid in maintaining the appearance of the shell 10 by sustaining most of the wear of the shell.

Figure 3:
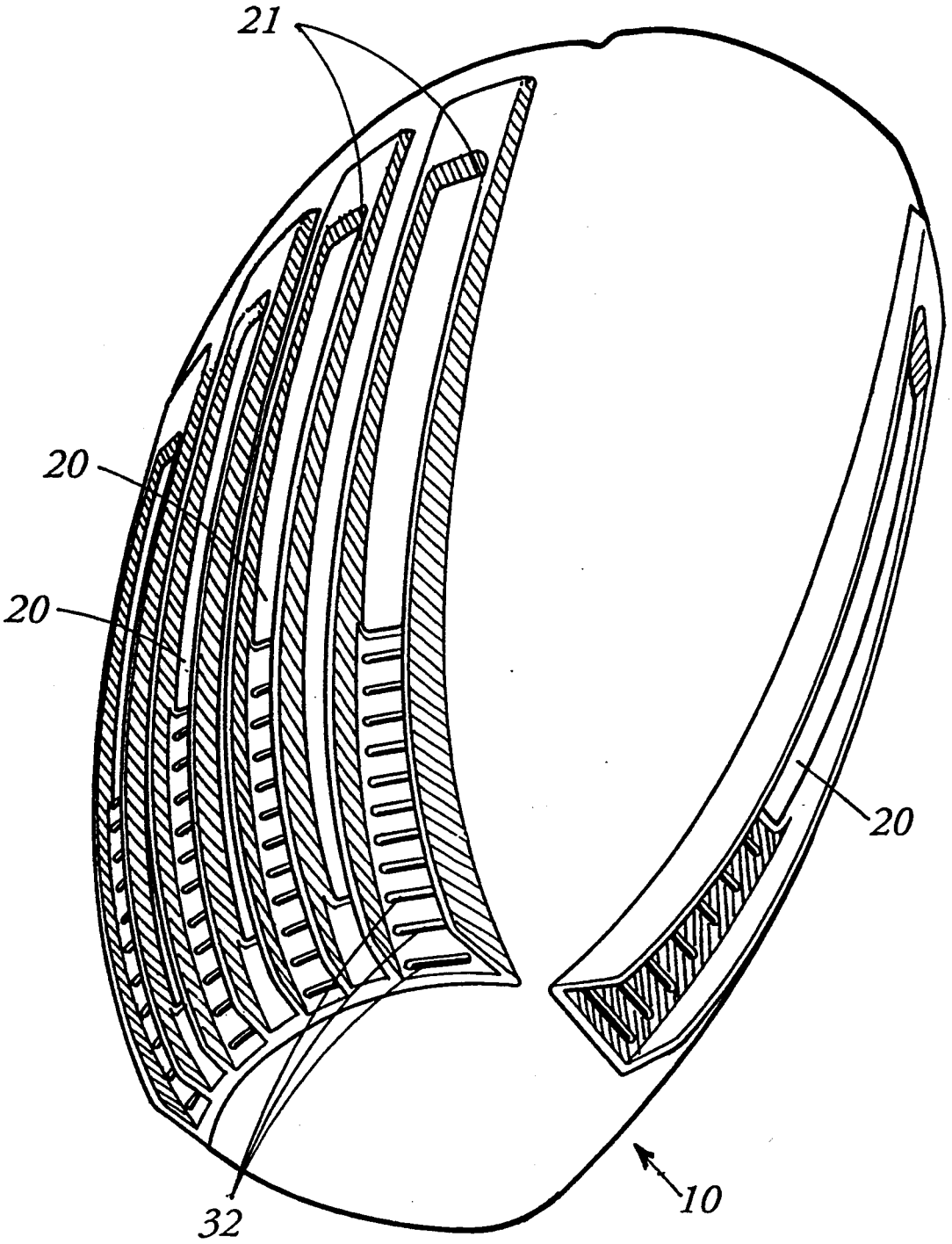
FIG. 3 is a rear view in perspective illustrating the preferred shell.

The convex rear surface of the shell 10, shown in FIG. 3, has channels 20 formed along finger regions, into which a person's fingers are placed. The sidewalls of the channels 20 form structural ribs 21 which help to reduce lateral motion of the fingers with respect to the shell 10, and increase the stiffness of the shell 10 along the channels 20. The increased stiffness helps to better transmit the force applied along the finger regions of the shell 10. The structural ribs 21 are formed on each side of the finger channels 20, extending along each finger channel 20 to near the edge of the shell 10. These ribs 21 are part of the skeleton 16 in the preferred embodiment. The ribs 21 provide selective rigidity to the shell 10, and function as a mechanical extension of the user's fingers, transmitting the force of the fingers to the shell 10, extending beyond the finger regions to near the edge of the shell 10. The ribs 21 permit control of the movement of the portion of the shell 10, which extends beyond the finger regions.

As shown in FIG. 1, the preferred shell 10 also has long, narrow slots 22 formed both between and generally parallel to the finger regions, as well as through a web region. The slots 22 form boundaries between the finger regions and reduce the transmission of motion of one region of the shell 10 to the adjacent region or regions. This property is very important in the finger regions where one finger region of the shell 10 can move somewhat independently of the surrounding finger regions. This permits more natural control of the shell 10 and therefore enhances the user's ability to grasp a ball with the shell 10 by surrounding it, rather than clamping or pinching a ball between the two flat sides of a conventional ball glove. The preferred slots 22 extend downwardly from near the top edge of the shell 10, shown in FIG. 1, terminating between the finger regions near where the crotches between a person's fingers are positioned when the ball glove is being used.

In addition to the slots 22, there are narrow, localized, generally linear bands called lines of preferred flexure 23 formed on the shell 10, along which the shell 10 is designed to flex. Each line of preferred flexure 23 preferably has a lower thickness than the immediately surrounding region of the shell 10, although other structures can produce the same results. The lines of preferred flexure 23 are formed at the ends of the slots 22 between the finger regions of the shell 10, along a path extending from between a thumb and palm region to the web region in the preferred embodiment and in various other places on the shell 10. The material at the lines of preferred flexure 23 flexes more easily than the surrounding material due to the reduced thickness. The lines of preferred flexure 23 are formed in and along specific regions of the shell 10 to promote a natural, hand-grasping closure of the shell 10 as well as promoting independent motion of each finger. FIG. 1A shows a line of preferred flexure 23 enlarged and viewed in section to illustrate the "necking" or reduction in thickness of the material along the line of preferred flexure 23.

Figure 8:
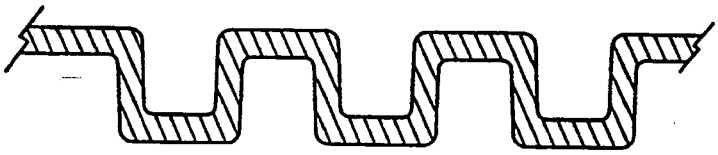
FIG. 8 is a view in section illustrating an alternative structure for forming lines of preferred flexure.
Figure 9:
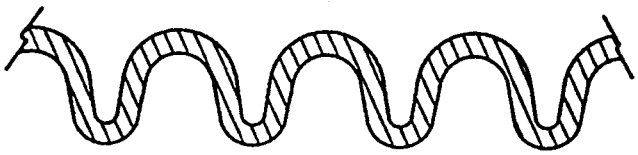
FIG. 9 is a view in section illustrating another alternative structure for forming lines of preferred flexure.

Regions of preferred flexure which will function similarly to the preferred "necked" structure forming the lines of preferred flexure 23 are illustrated in section in FIGS. 8 and 9. These include structures maintaining a constant thickness through their region.

FIG. 8 shows a "corrugated" structure retaining the same thickness as the surrounding structure. This embodiment localizes the flexure in the corrugated region, rather than the surrounding material, just as the preferred embodiment.

FIG. 9 illustrates a "scalloped" structure which functions similarly to the embodiment of FIG. 8 and demonstrates a second alternative to the line of preferred flexure 23.

The embodiments illustrated in FIGS. 8 and 9 show alternative structures for forming lines of preferred flexure and illustrate that the line of preferred flexure can be created without variations in thickness of the structure.

Referring again to FIG. 1, there are regions of the shell between the lines of preferred flexure 23, which are thicker than the lines of preferred flexure 23. These "padding" regions distribute the impact of a ball over a greater surface area than a thinner region would, thereby reducing the impact felt by the user.

The skeleton 16 also has a padding structure forming a "U" shaped region along the sides and lower perimeter of the shell 10. A thumb padding region 25, a palm padding region 27 including crests 24, and a heel padding region 29 form the padding structure of the skeleton 16. These give more rigidity to the sides of the shell 10 to enhance closure of the shell with the thumb and little finger of the user. The padding regions 25, 27 and 29 also deflect an incoming ball into the glove due to the angle they form with an impinging ball's trajectory when the shell 10 is held in its opened position. The padding regions 25, 27 and 29 also distribute the impact of an incoming ball over a large area to reduce the impact felt by the user.

Figure 4:
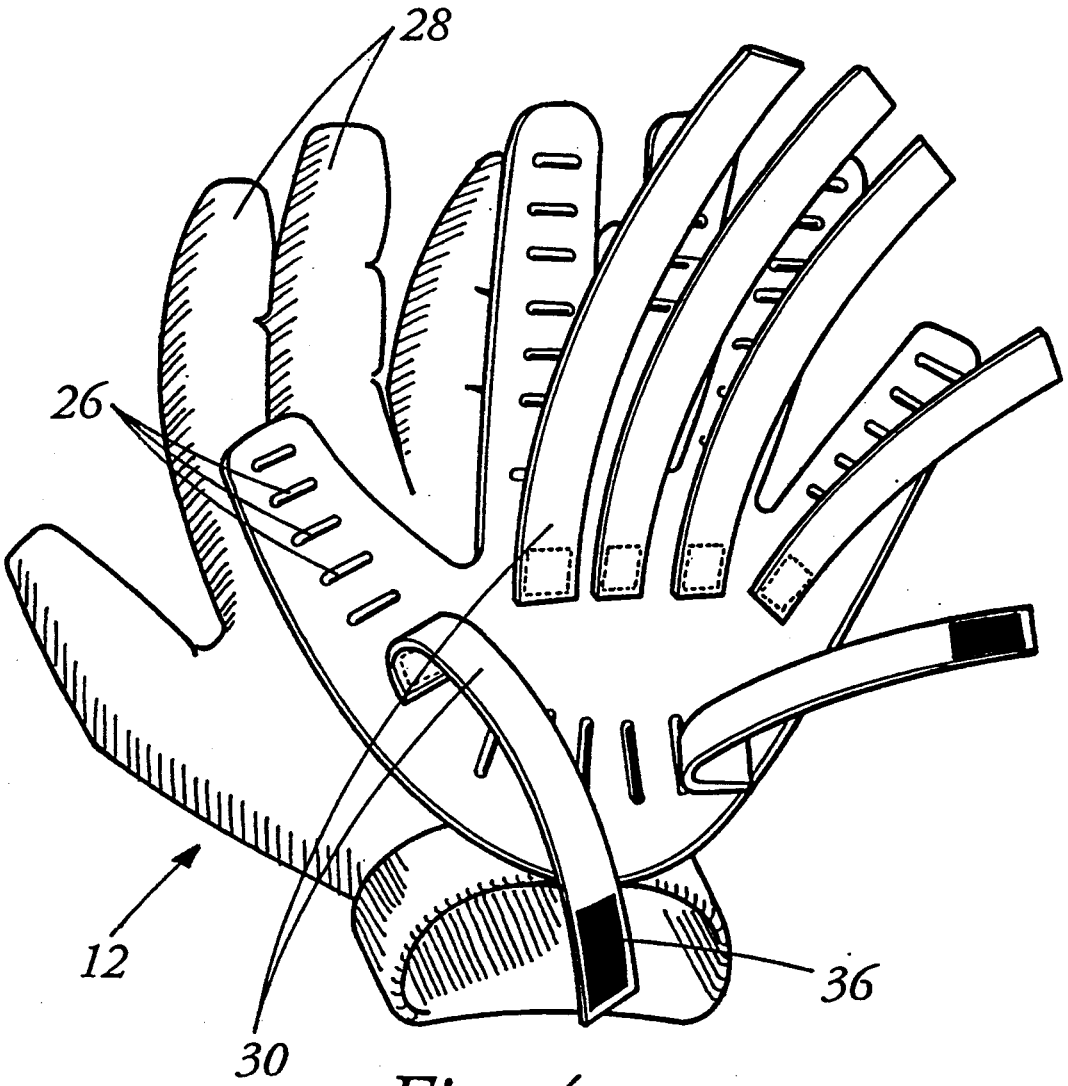
FIG. 4 is a frontal exploded view in perspective illustrating the preferred handpiece and showing a palm piece peeled away from the handpiece to show detail.

The preferred handpiece 12, shown in FIG. 4, is a tight fitting leather, or suitable fabric, glove that is removably fastened to the rear surface of the preferred shell 10, as shown in FIG. 1. In FIG. 4, five elongated regions of evenly spaced slots 26 are formed on and aligned parallel to each of five fingers 28 and a sixth elongated region of evenly spaced slots 26 is formed across a palm region of the handpiece 12. Corresponding strips 30, such as leather or nylon straps, are attached to an end of each elongated region of slots 26. An element 36 of a "hooks and loops" fastening means is attached to the end of each of the strips 30 and the backs of each finger 28. One type of "hooks and loops" material is sold under the trademark "Velcro".

Because a lightweight material can be used for the handpiece 12, it can conveniently be provided with ventilation passages formed through the rear (not visible in FIG. 4) to allow cooling air to pass through. The ventilation passages can be holes intentionally formed, as in the leather by a leather punch. The passages can also be gaps existing between the fibers of coarsely woven fabric that is used to form the rear of the handpiece 12.

The shell 10, illustrated in FIG. 3, preferably has elongated regions of evenly spaced slots 32 formed in each of five finger channels 20 and across a palm region, the slots 32 corresponding to the slots 26 in the handpiece 12. The surfaces of the handpiece 12 and the shell 10 are placed against each other, aligning the slots 26 and 32, and the strips 30 are woven alternately through the slots 26 formed in the handpiece 12 and the slots 32 formed in the finger channels 20. The hooks and loops elements 36 are pressed together after the strips 30 are woven through the corresponding slots 26 and 32, attaching each strip 30 to the back of each finger 28 and keeping it from being pulled back through the slots 26 and 32.

The above described method of attaching the handpiece 12 to the shell 10 allows variability in the positioning of the user's hand with respect to the shell 10. Each slot 26 in the handpiece may be aligned with any of the slots 32 in the shell 10, so that the position of the handpiece 12 may be varied longitudinally to suit the preference of the user. Additionally, the preferred attachment provides the benefit of attaching each finger 28 of the handpiece 12 separately to the shell 10, which provides maximum control and flexibility of the shell by the hand of the user, while allowing maximum independence of each individual finger of the user. By attaching the palm of the handpiece 12 to the shell 10 separately, even more variability is allowed. Since permitting the motion of each part of the user's hand to be independently transmitted to the shell 10 is of primary importance, the separate attachment of each finger to the shell 10 allows maximum fingertip control without binding each finger to its neighboring finger.

Figure 5:
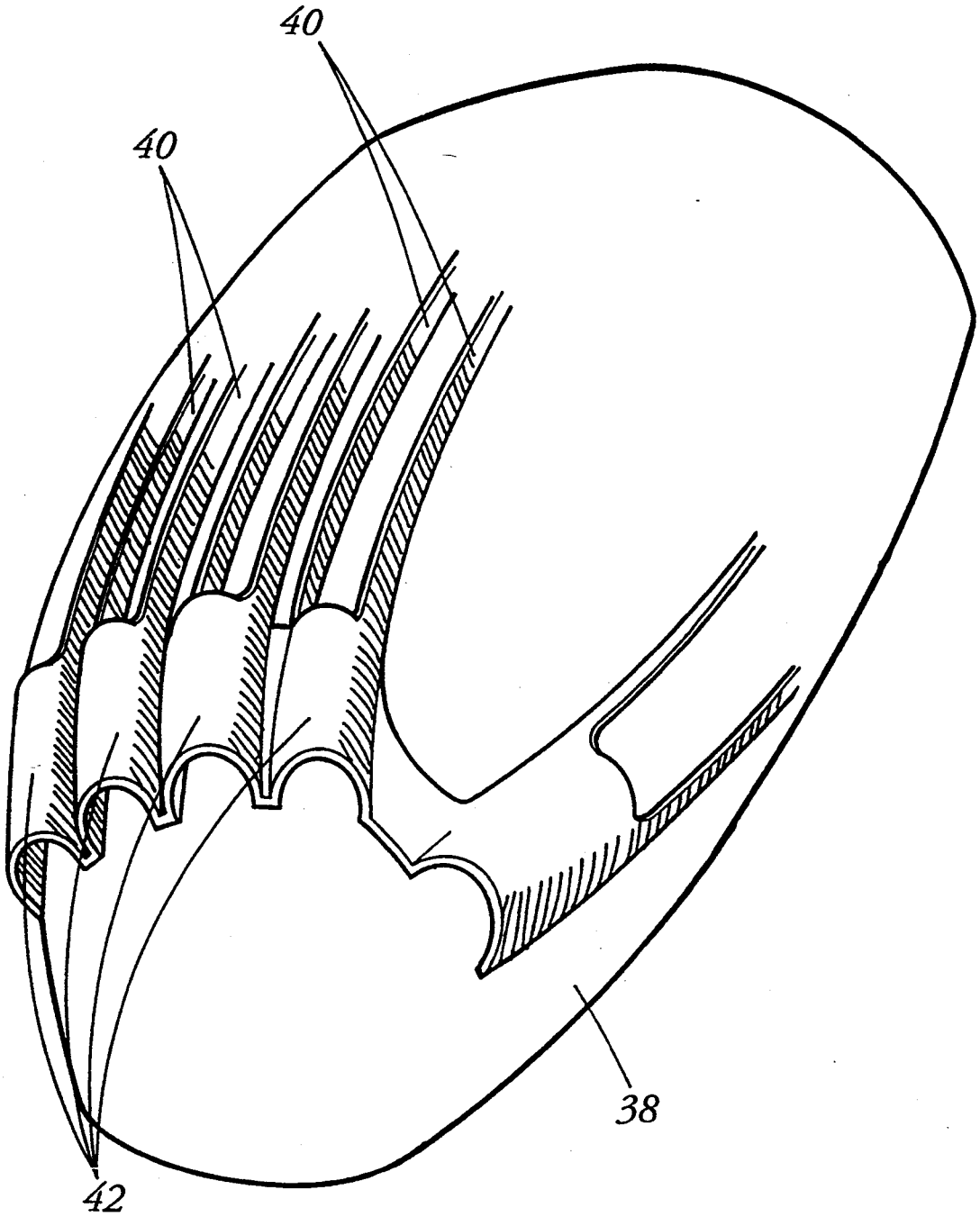
FIG. 5 is a rear view in perspective illustrating an alternative shell.

An alternative to the preferred shell 10 is a one piece shell 38, shown in FIG. 5, having the same general shape as the preferred shell 10, but made of only one kind of plastic, giving the shell 38 a homogeneous hardness. This alternative shell 38 has ribs 40 formed on either side of channels formed along finger regions, as in the preferred embodiment. There are also slots between each finger region and lines of preferred flexure, as in the preferred embodiment, but which are not visible in FIG. 5. The handpiece of the shell 38 comprises five loops 42, through which a user's fingers are inserted. The loops 42 are equivalent in function to a tight fitting glove attached to the back of a shell which is the preferred embodiment. The loops 42 are molded extensions of the shell 38, formed during the manufacture of the shell 38.

A handpiece, such as a glove, can be removably attached to nearly any shell giving wide variability in the possible combinations in the size and style of handpieces and attached shells. The same attachment means used in the preferred embodiment, or more simple structures, may be used on any of these variations. Examples of these alternative simple structures include "hooks and loops" material bonded to the mating surfaces of a glove and a shell, or straps which extend from a shell around the fingers of a handpiece and attach back to the shell. Straps 50, shown in FIG. 6, extend from a handpiece 47, through a shell, and attach back to the handpiece 47. With the two piece shell 10, a flexible flap 44, shown attached to a handpiece 46 in FIG. 7, may be placed between the skin 14 and the skeleton 16 of FIG. 2. The flap 44 is sandwiched between the skin 14 and the skeleton 16 in the palm region of the shell 10, fastening the palm of the handpiece 46 to the shell 10. Hooks and loops material 45 is attached to the flap 44 and the palm region of the shell 10, and they are engaged to hold the flap 44 in place once the shell 10 is assembled.

The preferred shell 10 and handpiece 12, illustrated in FIG. 1, are attached, as described above, by strips 30 woven through slots 26 and 32, as shown in FIGS. 3 and 4. The shell 10 and handpiece 12 could equivalently be assembled by adhering the handpiece 12 to the shell 10 with glue. The handpiece 12 could equivalently be attached to the shell 10 by attaching "hooks and loops" material to adjoining surfaces of the handpiece 12 and the rear surface of the shell 10 and compressing the two together.

Figure 6:
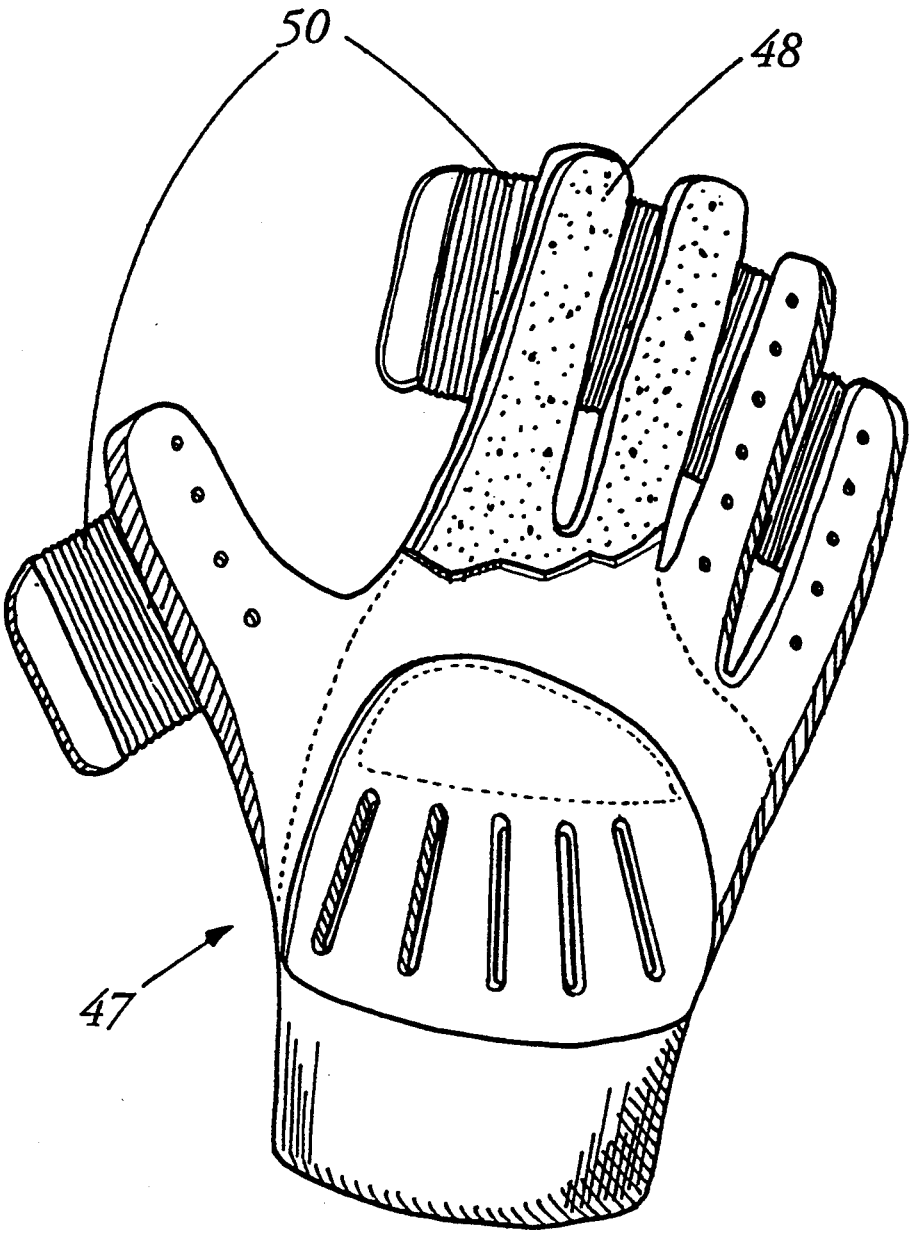
FIG. 6 is a frontal view in perspective illustrating an alternative handpiece.
Figure 7:
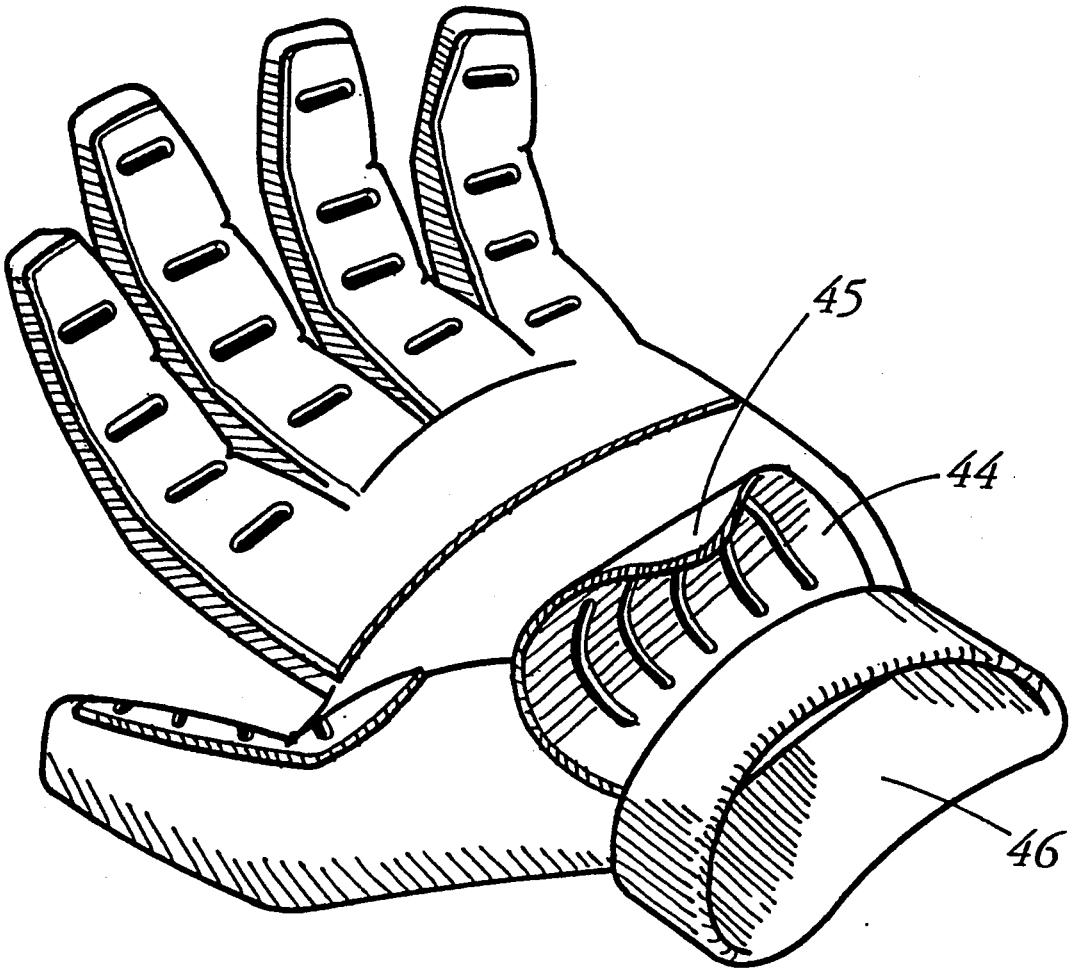
FIG. 7 is a view in perspective illustrating another alternative handpiece.

The handpiece 47, shown in FIG. 6, has padding 48 covering surfaces of the handpiece 47 that are between the user's hand and the skin surface where a ball which is caught may strike. This can be removably or permanently attached to the handpiece 47 to reduce, by spreading out over a large area, the impact of a ball on the user's hand. By making the padding 48 removable, the amount of padding can be varied to suit the user's preference. The padding 48 on the palm of the handpiece 47 may be neoprene foam, a jell-like material or a jell filled envelope which, upon impact, distributes the force and transforms the mechanical energy of the ball into heat energy by moving the soft padding, causing internal friction. The handpiece 47 not only can have different types of padding 48, but also may be used in conjunction with different shells to increase the variability of the ball glove.

The preferred embodiment of the present invention is a thermoplastic, elastomeric, injection molded ball glove. The properties of the glove ensure that it does not need to be "broken in". The ball glove is ready to use when it is fully assembled, and, as is a preferred characteristic of the selected plastic, the flexural and hardness characteristics of the glove will negligibly change over time. Additionally, the preferred plastic will be soft and pliant enough to conform to the motion of the user's hand.

The preferred method of manufacturing the present invention comprises injecting a liquid or semi-liquid thermoplastic polymer into a mold or number of molds having a cavity with the shape of the preferred shell or shell parts. The liquid plastic fills the mold, cools or cures and solidifies. The solidified plastic is then removed from the mold and a handpiece is attached after the shell and its parts are assembled, if necessary.

While certain preferred embodiments of the present invention have been disclosed in detail, it is to be understood that various modifications may be adopted without departing from the spirit of the invention or scope of the following claims.

I claim:

1. A ball glove comprising:

(a) a flexible, plastic shell molded into a curved, concave, frontal contour forming a ball-receiving surface and having a rear surface, the shell comprising a skeleton of frame members including reinforcing ribs attached along finger regions, and a sheet-like skin attached to the skeleton; and (b) a hand-receiving handpiece, attached to the rear of the shell along the finger regions of the shell.

2. A ball glove in accordance with claim 1 wherein the skeleton has a selected flexibility and the skin is more flexible than the skeleton.

3. A ball glove in accordance with claim 2 wherein a portion of the reinforcing ribs formed on the shell are formed extending longitudinally alongside each finger region, and the remaining portions of the reinforcing ribs extend beyond the finger regions to near a peripheral edge of the skin of the shell.

4. A ball glove in accordance with claim 3 wherein the reinforcing ribs are substantially parallel to each finger region.

5. A ball glove in accordance with claim 2 wherein the handpiece is removably attached to the shell.

6. A ball glove in accordance with claim 5 wherein the handpiece is removably attached to the shell by flexible strips laced alternately through spaced slits formed in the surfaces of the handpiece that engage the finger regions of the shell.

7. A ball glove in accordance with claim 6 wherein the handpiece is a glove.

8. A ball glove in accordance with claim 7 wherein a palm region of the glove is removably fastened to a palm region on the rear surface of the shell by a second flexible strip laced alternately through spaced slits formed in the adjoining surfaces of the palm region of the shell and the palm region of the glove.

9. A ball glove in accordance with claim 2 wherein the durometer hardness of the skeleton ranges between 65 and 90 on the shore A scale and the durometer hardness of the skin ranges between 50 and 70 on the shore A scale.

10. A ball glove in accordance with claim 1 wherein narrow regions of the shell are thinner than the adjacent area of the shell, forming lines of preferred flexure of the shell.

11. A ball glove in accordance with claim 10 wherein slots are formed through the shell between the finger regions for permitting local movement of finger regions of the shell with reduced influence from adjacent finger region movement.

12. A ball glove in accordance with claim 11 wherein the slots are formed between each of five finger regions.

13. A ball glove in accordance with claim 10 wherein the lines of preferred flexure extend from between a thumb and palm region of the shell to a web region of the shell.

14. A ball glove in accordance with claim 10 wherein at least one of the lines of preferred flexure is formed between each of five finger regions.

15. A ball glove in accordance with claim 1 wherein narrow regions of the shell are thinner than the adjacent area of the shell, forming lines of preferred flexure of the shell.

16. A ball glove in accordance with claim 15 wherein slots are formed through the shell between the finger regions for permitting local movement of finger regions of the shell with reduced influence from adjacent finger region movement.

17. A ball glove in accordance with claim 15 wherein the lines of preferred flexure extend from between a thumb and palm region of the shell to a web region of the shell.

18. A ball glove in accordance with claim 15 wherein at least one of the lines of preferred flexure is formed between each of five finger regions.

19. A ball glove in accordance with claim 1 wherein a plurality of raised bumps are formed on the outer perimeter of the ball-receiving surface.

20. A ball glove in accordance with claim 1 wherein a plurality of raised bumps are formed on the outer perimeter of the ball-receiving surface.

21. A ball glove in accordance with claim 1 wherein a plurality of raised bumps are formed on the ball-receiving surface in a web region and palm region.

22. A ball glove in accordance with claim 1 wherein a plurality of raised bumps are formed on the ball-receiving surface in a web region and palm region.

23. A ball glove in accordance with claim 1 wherein the shell is injection molded.

24. A ball glove in accordance with claim 1 wherein the shell is injection molded.

25. A ball glove in accordance with claim 1 wherein the shell is a thermoplastic elastomer.

26. A ball glove in accordance with claim 1 wherein the shell is a thermoplastic elastomer.

27. A ball glove in accordance with claim 1 wherein the skin is a thermoplastic elastomer.

28. A ball glove in accordance with claim 5 wherein the handpiece is removably attached to the shell by a fastening means comprising a plurality of flexible, plastic hooks extending from one of the two joined surfaces and a plurality of corresponding flexible, plastic loops extending from the other joined surface.

29. A ball glove in accordance with claim 28 wherein the handpiece is a glove.

30. A ball-glove in accordance with claim 7 wherein a flexible flap extends from a palm region of the glove to between palm regions of the skeleton and skin.

31. A ball glove in accordance with claim 5 wherein the handpiece is a glove and the glove is removably attached to the shell by straps extending from the finger regions of the shell around each finger of the glove.

32. A ball glove in accordance with claim 1 wherein the handpiece further comprises a glove adhered to the finger regions of the shell.

33. A ball glove in accordance with claim 1 wherein the handpiece further comprises a glove adhered to the finger regions of the shell.

34. A ball glove in accordance with claim 1 wherein the handpiece comprises a plurality of finger receivable loops molded on the rear surface of the shell at the finger regions.

35. A ball glove in accordance with claim 3 wherein the handpiece comprises a glove having impact energy distributing padding on palm and finger regions.

* * * * *